US007008302B2

(12) United States Patent
Wu et al.

(10) Patent No.: US 7,008,302 B2
(45) Date of Patent: Mar. 7, 2006

(54) CHEMICAL MECHANICAL POLISHING EQUIPMENT AND CONDITIONING THEREOF

(75) Inventors: Vinscent Wu, Nantou (TW); Hui-Shen Shih, Changhua Hsien (TW); Jason Lu, Taipei (TW)

(73) Assignee: United Microelectronics Corp., Hsinchu (TW)

( * ) Notice: Subject to any disclaimer, the term of this patent is extended or adjusted under 35 U.S.C. 154(b) by 0 days.

(21) Appl. No.: 10/841,394

(22) Filed: May 7, 2004

(65) Prior Publication Data

US 2005/0250425 A1 Nov. 10, 2005

(51) Int. Cl.
*B24B 1/00* (2006.01)

(52) U.S. Cl. ..... 451/56; 451/443

(58) Field of Classification Search ..... 451/56, 451/443, 285, 287, 41
See application file for complete search history.

(56) References Cited

U.S. PATENT DOCUMENTS 6,106,371 A * 8/2000 Nagahara et al. ..... 451/56
6,190,243 B1 * 2/2001 Wada et al. ..... 451/288
6,371,838 B1 * 4/2002 Holzapfel ..... 451/72
6,419,559 B1 * 7/2002 Gurusamy et al. ..... 451/41
6,500,054 B1 * 12/2002 Ma et al. ..... 451/56
6,672,949 B1 * 1/2004 Chopra et al. ..... 451/287
6,682,404 B1 * 1/2004 Brunelli ..... 451/53
6,752,698 B1 * 6/2004 Renteln et al. ..... 451/56
6,764,389 B1 * 7/2004 Butterfield et al. ..... 451/56

* cited by examiner

*Primary Examiner*—Eileen P. Morgan

(74) *Attorney, Agent, or Firm*—J.C. Patents

(57) ABSTRACT

A chemical mechanical polishing equipment has a polishing pad, a holder, a slurry supply and a conditioner. The holder is disposed above the polishing pad and carries a wafer for polishing the surface of wafer. The slurry supply is disposed above the polishing pad for supplying slurry onto the polishing surface. The conditioner is disposed near the polishing pad for removing the residual particles over the polishing pad. By disposing a plurality of block on the conditioner, the conditioner can provide with flexibility so that the conditioner can sufficiently contact with the polishing surface for increasing the removal rate of residual particles.

11 Claims, 4 Drawing Sheets

100

CHEMICAL MECHANICAL POLISHING EQUIPMENT AND CONDITIONING THEREOF

BACKGROUND OF THE INVENTION

1. Field of Invention

The present invention relates to semiconductor technology about the chemical mechanical polishing equipment and the conditioner. More particularly, the present invention relates to the chemical mechanical polishing equipment and the conditioner, which can improve the removing-rate of residual particles on the polishing pad.

2. Description of Related Art

For the planarization technology, the chemical mechanical polishing (CMP) technology has been widely used to have global planarization. In general, during the CMP process, the slurry with suspending abrasive particles and the polishing pad with proper elasticity and hardness are used, so as to achieve the planarization by a relative motion on the wafer surface.

FIG. 1 is a side view, schematically illustrating the conventional CMP equipment. FIG. 2 is a top view, schematically illustrating the conditioner and the polishing pad. In FIG. 1 and FIG. 2, the conventional CMP equipment 100 includes a polishing pad 110, a holder 120, a slurry supplier 130, a conditioning 140, and a gas supplier 150.

The polishing pad 110 has a polishing surface 112. The holder 120 is implemented above the polishing pad 110 to hold a wafer 10. This holder 120 carries the wafer 10 to have a relative motion between the surface of the wafer 10 and the polishing surface 112 of the polishing pad 110, so as to polish the surface of the wafer 10.

The slurry supplier 130 is implemented above the polishing pad 110. The slurry supplier 130 can supply the slurry 132, which has suspending abrasive particles, to the polishing pad 110 for performing polishing process. The surface of the wafer 10 contacts with the abrasive particles of the slurry 132, and the polishing effect is produced to move some surface material of the wafer 10. The wafer surface then gradually becomes planar.

The conditioning 140 is implemented around the polishing pad 110. This conditioning 140 is composed of a supporting rod 142 and a bar-shape conditioning member 144 disposed on the supporting rod 142, and the surface of the bar-shape conditioning member 144 has several diamond particles 146. The conditioning 140 is suitable for repeated moving along a conditioning path A, such as an arc path, on the polishing surface 112, and the bar-shape conditioning member 144 can clean the residual particles left on the polishing surface 112 during the polishing process (see FIG. 2). In this manner, the produced residual particles on the polishing surface 112, after a certain number of times in polishing wafers, are cleaned by the conditioning 140, so as to maintain the uniform polishing of the polishing pad 110.

The gas supplier 150 is implemented under the polishing pad 110. The gas supplier 150 can supply a gas to the bottom of the polishing pad 110, and more particularly to the central region of the bottom of the polishing pad 110. In this manner, the central region of the polishing pad 110 is more protruding than the peripheral region. As a result, the polishing pad 110 can keep the pressure exerted by the holder 120 and the conditioning 140.

However, the bar-shape conditioning member 144 of the conditioning 140 has the larger hardness relatively than the supporting rod 142, and the bar-shape conditioning member 144 is disposed on the whole surface of the supporting rod 142. This causes the loss of flexibility for the supporting rod. Therefore, when the gas supplier 150 supplies the gas to the bottom of the polishing pad 110, causing the central region of the polishing pad 110 to be higher than the peripheral region, the supporting rod 142 is confined by the bar-shape conditioning member 144 and can not be changed in shape. In this situation, the bar-shape conditioning member 144 cannot fully contact onto the whole part of the polishing surface 112. As a result, when the conditioner 140 repeatedly moves along the conditioning path A on the polishing surface 112, residual particles at some region cannot be cleaned by the conditioning 140 because the polishing surface 112 does not contact with the bar-shape conditioning member 144 at the region. The polishing uniformity for the polishing pad 110 is reduced.

SUMMARY OF THE INVENTION

The invention provides a CMP equipment and the conditioner. The conditioning can have substantially full contact with the polishing pad to reduce the residual particles on the polishing pad, so as to improve the polishing uniformity The present invention provides a CMP equipment, including a polishing pad, a holder, a slurry supplier and a conditional. The holder is implemented above the polishing pad for holding a wafer. The slurry supplier is implemented above the polishing pad. The conditioning is implemented around the polishing pad. The conditioning can move along a conditioning path on the polishing surface. The conditioner includes a supporting rod and a plurality of conditioning blocks. The conditioning blocks, being disposed with the diamond particles, are disposed on the supporting rod, and a clearance exists between the conditioning blocks.

The invention in another aspect provides a conditioner of a CMP equipment, suitable for repeatedly moving along a conditioning path on a polishing pad. The conditioner includes a supporting rod and a plurality of conditioning blocks. The conditioning blocks are disposed on the supporting rod, and a clearance exists between the conditioning blocks.

For the CMP equipment of the invention, the conditioner is design with multiple conditioning blocks and a clearance exits between the condition blocks. This design allows the conditioner to be flexible and be substantially full contact with polishing pad, so as to reduce the residual rate of the residual particles on the polishing pad and further improve polishing uniformity.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE PREFERRED EMBODIMENTS

Figure 1:
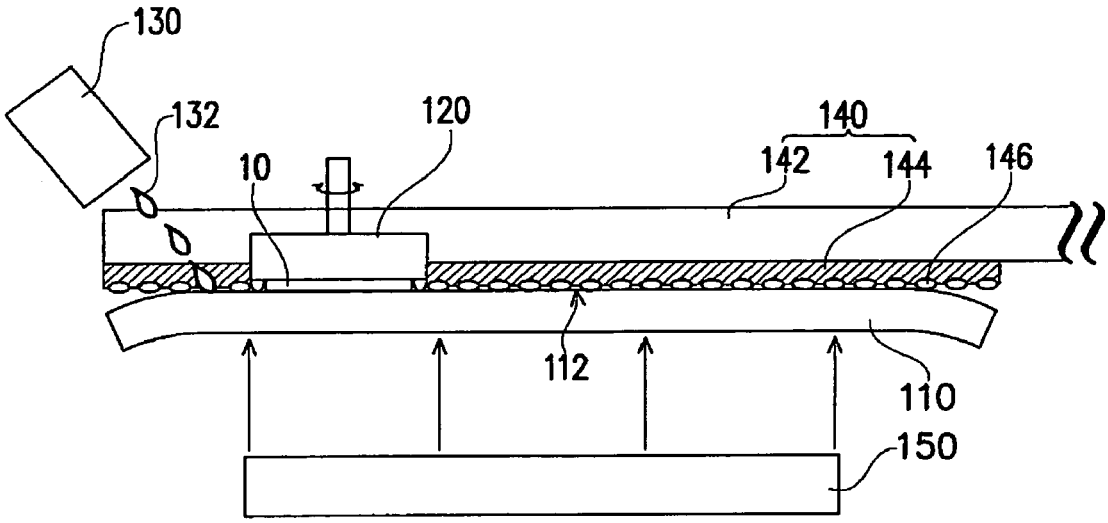
FIG. 1 (PRIOR ART)
FIG. 1 is a side view, schematically illustrating a conventional CMP equipment.
Figure 2:
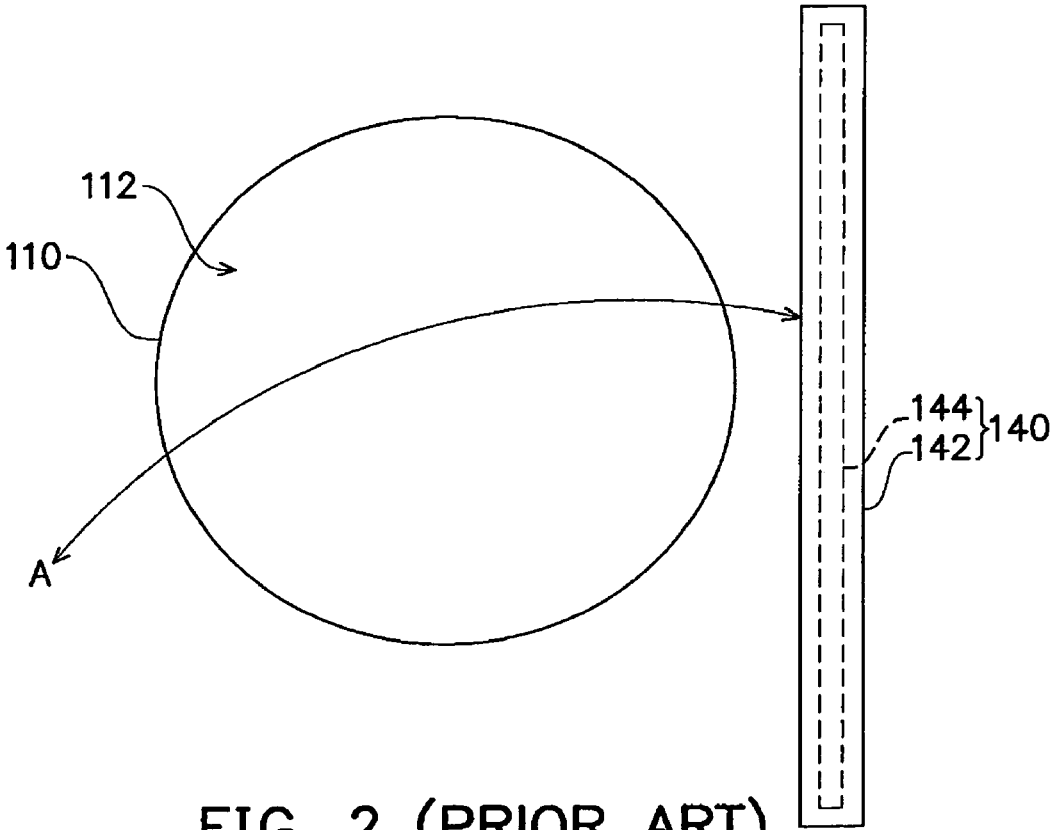
FIG. 2 (PRIOR ART)
FIG. 2 is a top view, schematically illustrating a conventional conditioner and polishing pad.
Figure 3:
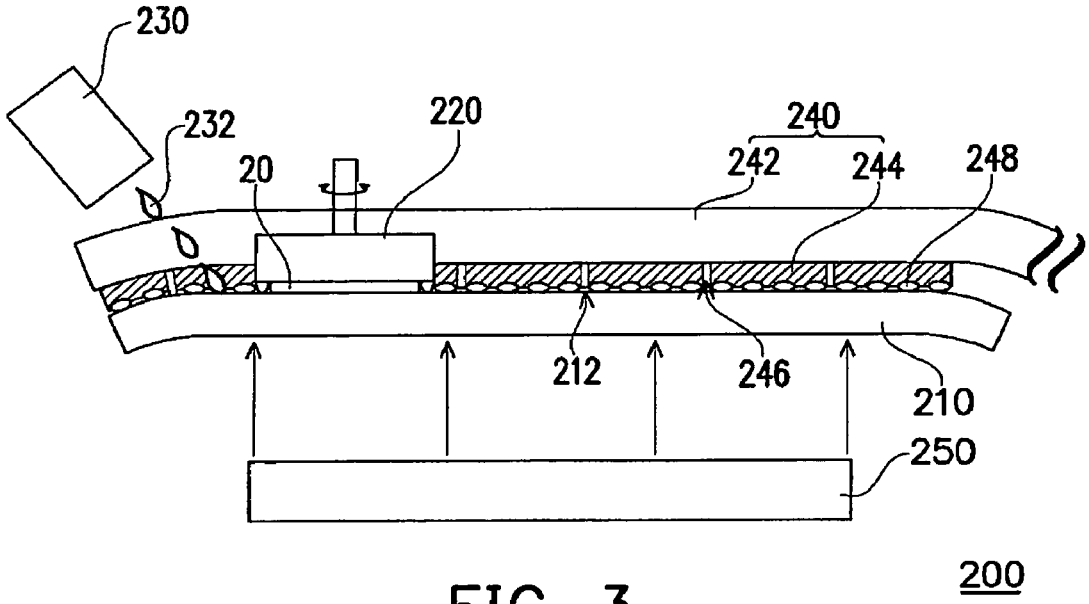
FIG. 3 is a side view, schematically illustrating a CMP equipment, according to a preferred embodiment of the invention.
Figure 4:
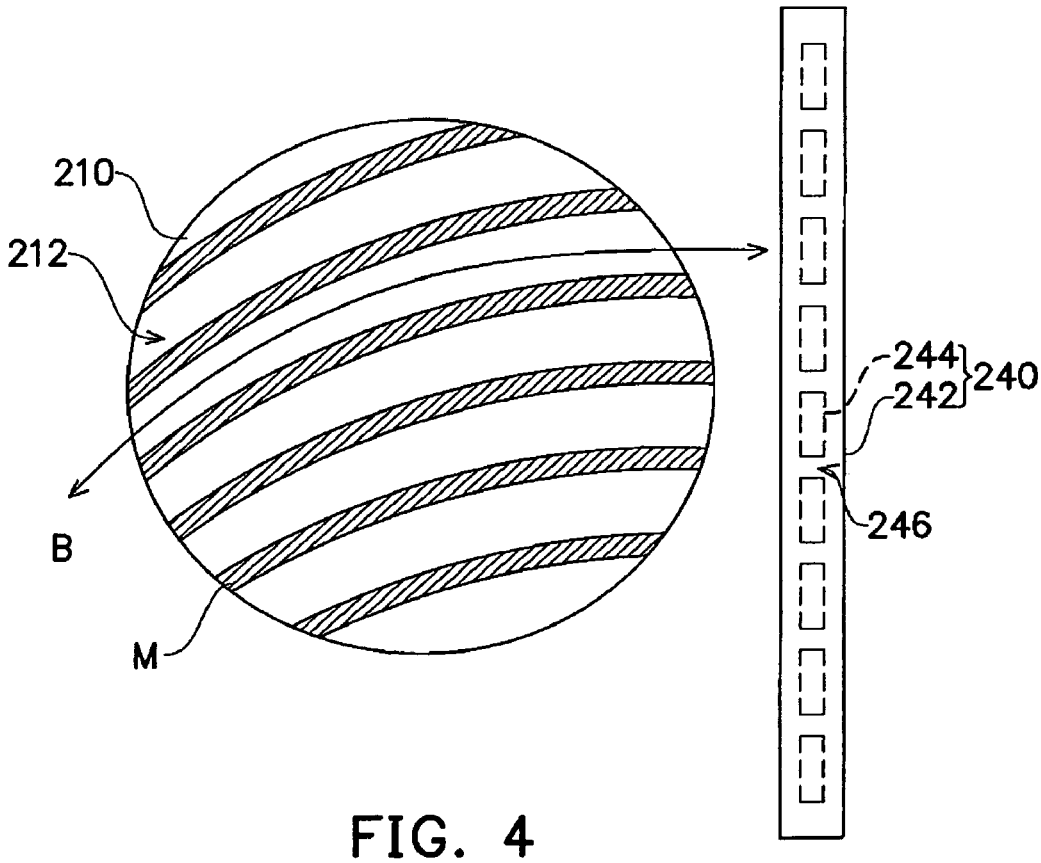
FIG. 4 is a top view, schematically illustrating a conditioner and polishing pad, according to a preferred embodiment of the invention.

FIG. 3 is a side view, schematically illustrating a CMP equipment, according to a preferred embodiment of the invention. FIG. 4 is a top view, schematically illustrating a conditioner and polishing pad, according to a preferred embodiment of the invention. In FIGS. 3 and 4, the CMP equipment 200 of the invention includes a polishing pad 210, a holder 220, a slurry supplier 230, a conditioner 240, and a gas supplier 250.

The polishing pad 210 has a polishing surface 212. The holder 220 is implemented above the polishing pad 210 to hold a wafer 20. This holder 220 carries the wafer 20 to have a relative motion between the surface of the wafer 20 and the polishing surface 212 of the polishing pad 210, so as to polish the surface of the wafer 20. The relative motion between the wafer 20 and the polishing pad 210 includes rotating motion and also the left-right shift motion of the wafer 20.

The slurry supplier 230 is implemented above the polishing pad 210. The slurry supplier 230 can supply the slurry 232, which has suspending abrasive particles, to the polishing pad 210 for performing polishing process. The surface of the wafer 20 contacts with the abrasive particles of the slurry 232, and the polishing effect is produced to move some surface material of the wafer 20. The wafer surface then gradually becomes planar.

The conditioning 240 is implemented around the polishing pad 210. This conditioning 240 is composed of a supporting rod 242 and multiple conditioning blocks 244. The conditioning blocks 244 are implemented on the supporting rod 242 and a clearance 246 exits between the conditioning blocks 244. In other words, the conditioning blocks 244 are not joined to each other but have a gap. The surface of the conditioning blocks 244 is disposed with several hard particles 248, such as diamond particles. The conditioning 240 is suitable for repeated moving along a conditioning path B, such as an arc path, on the polishing surface 212, and the conditioning blocks 244 can clean the residual particles left on the polishing surface 112 during the polishing process (see FIG. 4).

The gas supplier 250 is implemented under the polishing pad 210. The gas supplier 250 can supply a gas to the bottom of the polishing pad 210, and more particularly to the central region of the bottom of the polishing pad 210. In this manner, the central region of the polishing pad 210 is more protruding than the peripheral region. As a result, the polishing pad 210 can keep the pressure exerted by the holder 220 and the conditioning 240.

Also referring to FIG. 3 and FIG. 4, since the conditioning 240 of the invention implements several conditioning blocks 240 on the supporting rod 242 and the clearance 246 exists between the conditioning blocks 244, by this design, the supporting rod 244 can be flexible and changed in shape. When the gas supplier 250 supplies gas to the bottom of the polishing pad 210, the central region of the polishing pad 210 is more protruding than the peripheral region. Even in this situation, the conditioner 240 can still have effectively full contact with the polishing pad 210, so as to reduce the probability of the residual particles being left on the polishing pad 210. The polishing uniformity for the polishing pad 210 can be further improved.

In addition, in FIG. 4, the conditioning blocks 244 has the rectangular shape arranged in a row. In drawing, when the conditioner 240 moves along the conditioning path B on the polishing surface 212, the residual particles on the polishing pad 210 at the region with respect to the clearance 246, as indicated by the region M, may not be brushed. In other words, even though the conditioning blocks 244 with rectangular shape in row can allow the conditioner 240 to be flexible and have about full contact with the surface of the polishing pad 210, the specific region on the polishing pad 210 may not be brushed. In order to prevent this situation from occurring, the invention proposed another aspects to arrange the conditioning blocks 244 on the conditioner 240, so as to effectively remove the residual particles on the polishing surface 212 and achieve the cleaning effect. Details are described as follows.

Figure 5:
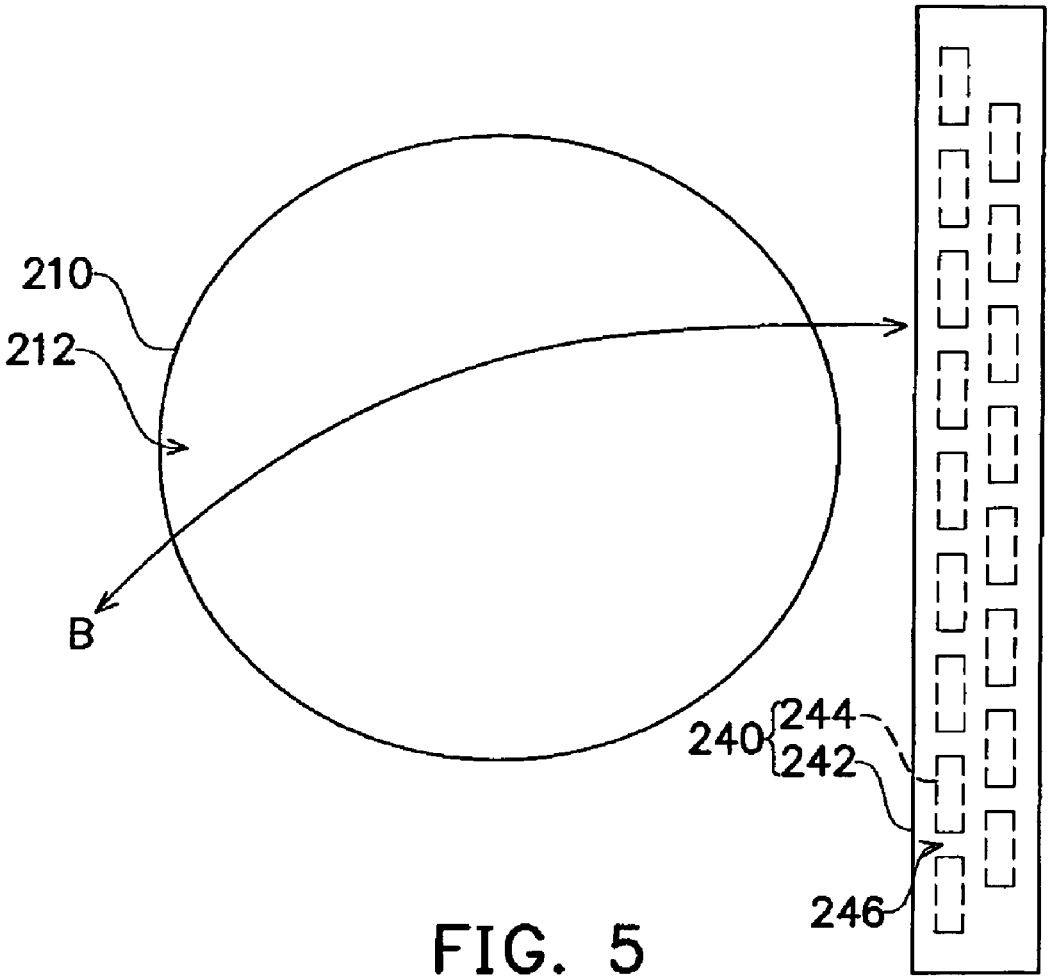
FIG. 5 is a top view, schematically illustrating a conditioner and polishing pad, according to another preferred embodiment of the invention.

FIG. 5 is a top view, schematically illustrating a conditioner and polishing pad, according to another preferred embodiment of the invention. In FIG. 5, the rectangular shape for the conditioning blocks 244 is still used but the conditioning blocks are arranged in multiple rows. Two rows are taken as the example for descriptions. In the adjacent two rows, the conditioning blocks are alternatively shifted. By this arrangement, when the conditioner 240 moves on the conditioning path B on the polishing pad 210, the region of the polishing pad 210 with respect to the clearance 246 can also be conditioned by the conditioning blocks 244. In other words, when the conditioning block 240 moves along the conditioning path B on the polishing surface 212, the conditioning blocks 244 of each row with the conditioning blocks 244 for the adjacent row can contact the whole surface of the polishing pad 210 during the polishing process.

Figure 6:
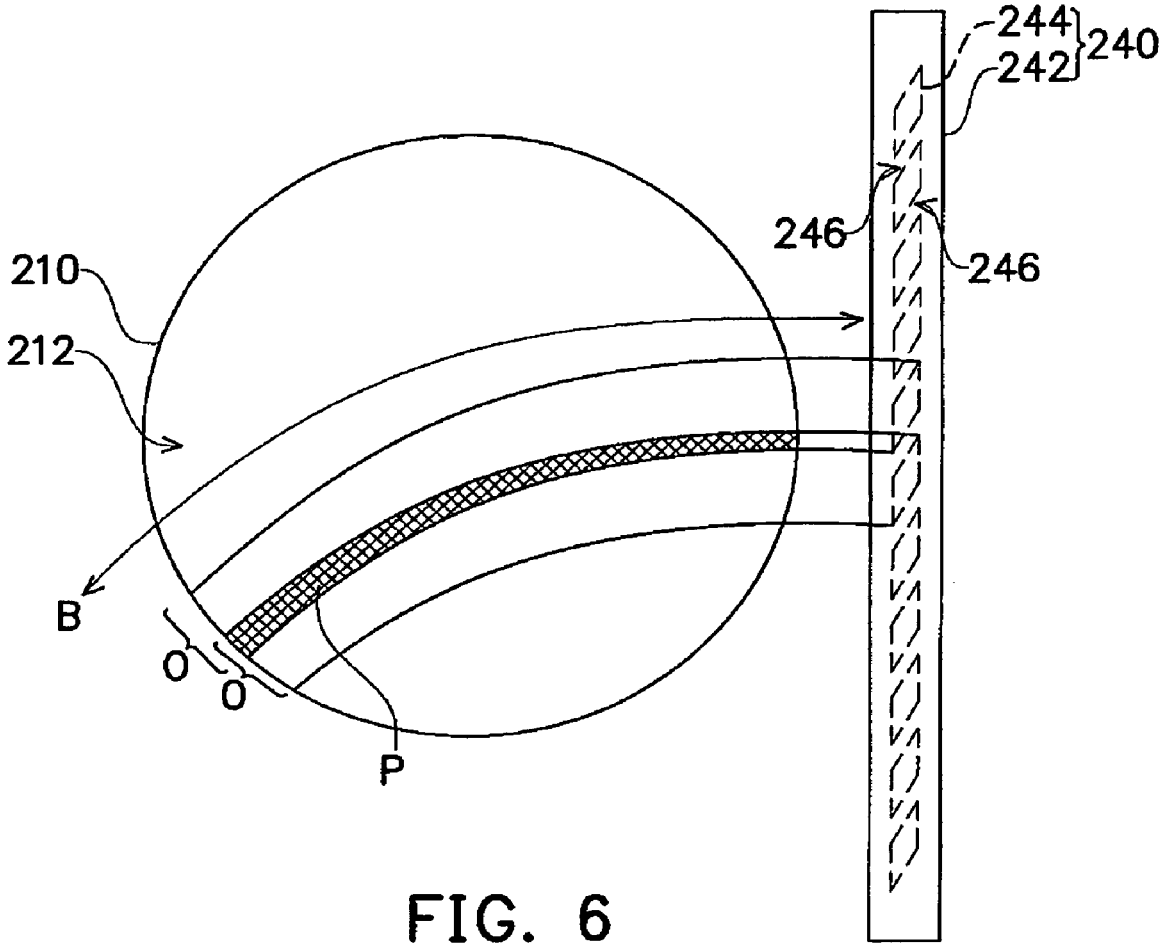
FIG. 6 is a top view, schematically illustrating a conditioner and polishing pad, according to further another preferred embodiment of the invention.

FIG. 6 is a top view, schematically illustrating a conditioner and polishing pad, according to further another preferred embodiment of the invention. In FIG. 6, the shape of the conditioning blocks 244 is, for example, designed with the rhombic shape in single row. By the change of shape for the conditioning blocks 244, when the conditioner 240 moves along the conditioning path B on the polishing pad 210, the region of the polishing pad 210 with respect to the clearance 246 can also be brushed by the conditioning blocks 244. In more detailed description, when the conditioner 240 moves along the conditioning path B on the polishing surface 212, each rhombic conditioning block 244 on the polishing surface 212 forms a region 0. The current region 0 has an overlapping region (indicated by region P) with the region 0 formed from the adjacent conditioning block 244 on the polishing surface 212. As a result, diamond blocks 244 can contact the whole surface of the polishing pad 210 during the motion.

Figure 7:
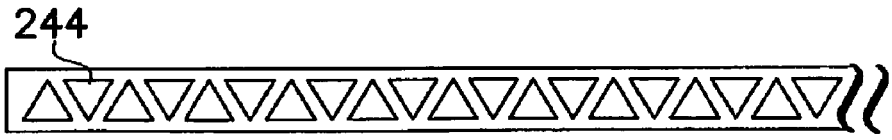
FIGS. 7–9 are top views, schematically illustrating conditioners, according to further other preferred embodiments of the invention.
Figure 8:
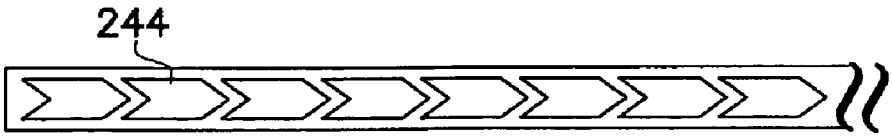
Figure 9:
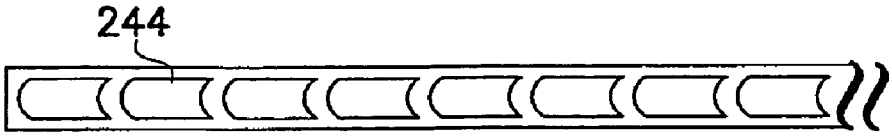

FIGS. 7–9 are top views, schematically illustrating conditioners, according to further other preferred embodiments of the invention. In FIGS. 7–9, the invention is limited to the rhombic shape. For example, the block shape can be triangle, as shown in FIG. 7, or other irregular shape, as shown in FIGS. 8 and 9. All of these conditioning blocks 244 can effectively contact the whole surface of the polishing pad during the motion. The removal rate for the residual particles can be improved. In addition, for the ordinary skilled artisans, the design for the rectangular shape of the conditioning blocks 244 in one row is the only design. Multiple rows can also be applied.

In the foregoing descriptions, the CMP equipment of the invention at least has the advantages as follows:

1. The conditioner is designed with multiple conditioning blocks and a clearance exists between the conditioning blocks. This allows the conditioner to be flexible and can have effectively full contact with the polishing pad. The probability of the residual particles being left on the polishing pad can be reduced. The polishing uniformity for the polishing pad can be further improved.

2. The conditioner has multiple conditional blocks arranged in multiple rows by alternative shift. When the conditioner 240 moves along the conditioning path on the polishing pad, the residual particles on the polishing pad at the region with respect to the clearance can be brushed by the conditioning blocks. During conditioning motion, the conditioning blocks can contact the whole surface of the polishing pad, so as to effectively remove the residual particles.

3. The conditioner has multiple conditional blocks in rhombic shape, triangular shape, or irregular shape, which are arranged in multiple rows. When the conditioner 240 moves along the conditioning path on the polishing pad, the residual particles on the polishing pad at the region with respect to the clearance can be brushed by the conditioning blocks. During motion, the conditioning blocks can contact the whole surface of the polishing pad, so as to effectively remove the residual particles.

It will be apparent to those skilled in the art that various modifications and variations can be made to the structure of the present invention without departing from the scope or spirit of the invention. In view of the foregoing, it is intended that the present invention covers modifications and variations of this invention provided they fall within the scope of the following claims and their equivalents.

What is claimed is:

1. A chemical mechanical polishing equipment, comprising:

a polishing pad, having a polishing surface;

a holder, implemented above the polishing pad for holding a wafer facing the polishing surface;

a slurry supplier, implemented above the polishing pad;

a conditioner, implemented above the polishing pad, capable of moving along a conditioning path on the polishing surface, wherein the conditioner comprises:

a supporting rod having a longitudinal axis; and a plurality of conditioning blocks facing the polishing surface, implemented on the supporting rod, wherein the conditioning blocks are non-rotatable along the supporting rod and are spaced by a clearance between adjacent conditioning blocks, wherein at least part of a conditioning surface of one block overlaps at least part of a conditioning surface of an adjacent block along the direction of the longitudinal axis, so that the entire polishing surface is conditioned when conditioner moves along the conditioning path on the polishing surface.

2. The chemical mechanical polishing equipment of claim 1, wherein the conditioning blocks of the conditioner have an arrangement to allow a region of the polishing pad with respect to the clearance to also be conditioned by the conditioning blocks when the conditioner moves along the conditioning path.

3. The chemical mechanical polishing equipment of claim 1, wherein shapes of the conditioning blocks are rectangular, rhombic, triangular, or irregular.

4. The chemical mechanical polishing equipment of claim 1, wherein a surface of the conditioning blocks is disposed with hard particles.

5. The chemical mechanical polishing equipment of claim 4, wherein the hard particles are diamond particles.

6. The chemical mechanical polishing equipment of claim 1, further comprising a gas supplier, implemented under the polishing pad, and supplying a gas to bottom of the polishing pad.

7. A conditioner for a chemical mechanical polishing equipment, suitable for moving on a polishing pad along a conditioning path for conditioning a polishing surface of the polishing pad, the conditioner comprising:

a supporting rod; having a longitudinal axis and a plurality of conditioning blocks facing the polishing surface, implemented on the supporting rod, wherein the conditioning blocks are non-rotatable along the supporting rod and are spaced by a clearance between adjacent conditioning blocks, wherein at least part of a conditioning surface of one block overlaps at least part of a conditioning surface of an adjacent block along the direction of the longitudinal axis, so that the entire polishing surface is conditioned when conditioner moves along the conditioning path on the polishing surface.

8. The conditioner of claim 7, wherein the conditioning blocks of the conditioner have an arrangement to allow a region of the polishing pad with respect to the clearance to also be conditioned by the conditioning blocks when the conditioner moves along the conditioning path.

9. The conditioner of claim 7, wherein shapes of the conditioning blocks are rectangular, rhombic, triangular, or irregular.

10. The conditioner of claim 7, wherein a surface of the conditioning blocks is disposed with hard particles.

11. The conditioner of claim 10, wherein the hard particles are diamond particles.

* * * * *